US006686913B2

(12) United States Patent
Engler et al.

(10) Patent No.: US 6,686,913 B2
(45) **Date of Patent: *Feb. 3, 2004**

(54) ANALOG CONDITIONING CIRCUITRY FOR IMAGERS FOR A DISPLAY

(75) Inventors: David W. Engler, Houston, TX (US); Mark W. Welker, Spring, TX (US)

(73) Assignee: Duke University, Durham, NC (US)

( * ) Notice: Subject to any disclaimer, the term of this patent is extended or adjusted under 35 U.S.C. 154(b) by 185 days.

This patent is subject to a terminal disclaimer.

(21) Appl. No.: 09/891,401

(22) Filed: Jun. 27, 2001

(65) Prior Publication Data

US 2002/0126109 A1 Sep. 12, 2002

Related U.S. Application Data

(63) Continuation of application No. 09/183,913, filed on Oct. 31, 1998.

(51) Int. Cl.[7] ..... G09G 5/00

(52) U.S. Cl. ..... 345/211; 345/101; 345/204; 345/212; 345/213; 345/98

(58) Field of Search ..... 345/211, 204, 345/212, 213, 98, 101

(56) References Cited

U.S. PATENT DOCUMENTS 5,739,816 A 4/1998 Kobayashi et al. ..... 345/204
5,754,156 A 5/1998 Erhart et al. ..... 345/98
5,757,298 A 5/1998 Manley et al. ..... 341/138
5,805,150 A 9/1998 Nishino et al. ..... 345/213
6,300,945 B1 * 10/2001 Engler et al. ..... 345/211

OTHER PUBLICATIONS

Analog Devices, Inc., "Low Cost, High Speed Rail–to–Rail Amplifiers, AD8051/AD8052/AD8054," 1997, pp. 1–16, REV. 0.

Analog Devices, Inc., "1–/2–/4–Channel Digital Potentiometers, AD8400/AD8402/AD8403," 1997, pp. 1–20, REV. B.

* cited by examiner

*Primary Examiner*—Richard Hjerpe
*Assistant Examiner*—Ali Zamani
(74) *Attorney, Agent, or Firm*—Fleshner & Kim, LLP

(57) ABSTRACT

A monitor provides analog conditioning circuitry for supplying a symmetrical high speed analog output signal generated from inverted and non-inverted digital data to imagers for a display of the monitor. The circuitry includes an upper bias amplifier for generating a precision upper DC offset signal. a lower bias amplifier for generating a precision lower DC offset signal, a switch for alternating selection of a precision DC offset signal with each frame, and a summing amplifier for adding the selected precision DC offset signal to a high speed analog signal provided by a digital-to-analog converter. Selection of the precision DC offset signal is controlled by an inversion signal provided to the switch from an inversion bit of a display controller. The digital data inversion is controlled by inversion circuitry within the display controller. The analog conditioning circuitry thus provides a single gain path and also provides low speed signal paths decoupled from a high speed signal path.

20 Claims, 4 Drawing Sheets

ANALOG CONDITIONING CIRCUITRY FOR IMAGERS FOR A DISPLAY

This application claims benefit from the co-pending application of the same title, filed on Oct. 31, 1998, and assigned application Ser. No. 09/183,913.

This application is a Continuation of application Ser. No. 09/183,913, filed Oct. 31, 1998.

BACKGROUND OF THE INVENTION

1. Field of the Invention

The present invention relates to analog drive circuitry, and more particularly to analog drive conditioning for imagers for a display.

2. Description of the Related Art

A conventional video monitor typically includes a display, a display controller, imagers, and drive circuitry. The display controller gathers video information from a host system (e.g., a computer) connected to the monitor and sends the video information to the drive circuitry for writing to the display. The drive circuitry (or driver) is essentially an interface circuit for passing video information from a host system to the imagers. In the context of a monitor, an imager or light valve is basically a light transducer device for converting electrical energy containing light intensity modulation information to light energy emitted to the display. An imager typically either transmits or reflects the light energy for visualization by a user.

Analog imagers have been driven by analog drive circuitry. Conventional analog drive circuitry has typically provided a positive gain stage and a negative gain stage. Such circuitry has alternated between a positive gain mode and a negative gain mode. This is typically accomplished by selectively disabling and enabling the positive gain stage and the negative gain stage. During a positive gain mode, the positive gain stage is enabled and a negative gain stage is disabled. The resulting bias voltage signal is a voltage signal having a positive offset from an arbitrary reference voltage signal. During a negative gain mode, the negative gain stage is enabled and the positive gain stage is disabled. The resulting bias voltage signal is a voltage signal having a negative offset from the arbitrary reference voltage signal. The goal has been to match the amplitude of the positive offset of the bias voltage signal from the arbitrary reference voltage signal during a positive gain mode with the amplitude of the negative offset of the bias voltage signal from the arbitrary reference signal during a negative gain mode.

One disadvantage of such analog drive circuitry is that the positive gain stage and negative gain stage have been in separate gain paths. This has presented a difficulty in matching the two gain paths. Another disadvantage of conventional analog drive circuitry has been the need to make adjustments in a gain path.

One conventional low speed analog drive circuitry implementation has been to wire OR the positive gain stage and the negative gain stage. This wire OR approach has involved switching transients and other undesirable effects. Another limitation of conventional analog drive circuitry has been that only certain types of non-standard gain sources may be utilized.

SUMMARY OF THE INVENTION

Briefly, in accordance with the present invention, a monitor provides analog conditioning circuitry for supplying a symmetrical high speed analog output signal generated from inverted and non-inverted digital data to imagers for a display of the monitor. The circuitry includes an upper bias amplifier for generating a precision upper DC offset signal, a lower bias amplifier for generating a precision lower DC offset signal, a switch for alternating selection of a precision DC offset signal with each frame, and a summing amplifier for adding the selected precision DC offset signal to a high speed analog signal provided by a digital-to-analog converter. Selection of the precision DC offset signal is controlled by an inversion signal provided to the switch from an inversion bit of a display controller. The digital data inversion is controlled by inversion circuitry within the display controller. The analog conditioning circuitry thus provides a single gain path and also provides low speed signal paths decoupled from a high speed signal path.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

The following patent application is hereby incorporated by reference as if set forth in its entirety:

- Commonly-assigned and concurrently filed U.S. Patent Application, bearing Attorney Docket No. A98067US, entitled "EFFICIENT PIXEL PACKING";
- Commonly-assigned and concurrently filed U.S. Patent Application, bearing Attorney Docket No. A98068US, entitled "NON-LINEAR COLOR CORRECTION TO A VISUAL LINEAR RESPONSE WHILE MAINTAINING COLOR DEPTH";
- Commonly-assigned and concurrently filed U.S. Patent Application, bearing Attorney Docket No. A98072US, entitled "HIGHLY EFFICIENT BIT MAPPED PULSE WITH MODULATION"; and
- Commonly-assigned and concurrently filed U.S. Patent Application, bearing Attorney Docket No. A98071US, entitled "AUTOMATIC DC BALANCING CIRCUITRY FOR IMAGERS FOR A DISPLAY."

Figure 1:
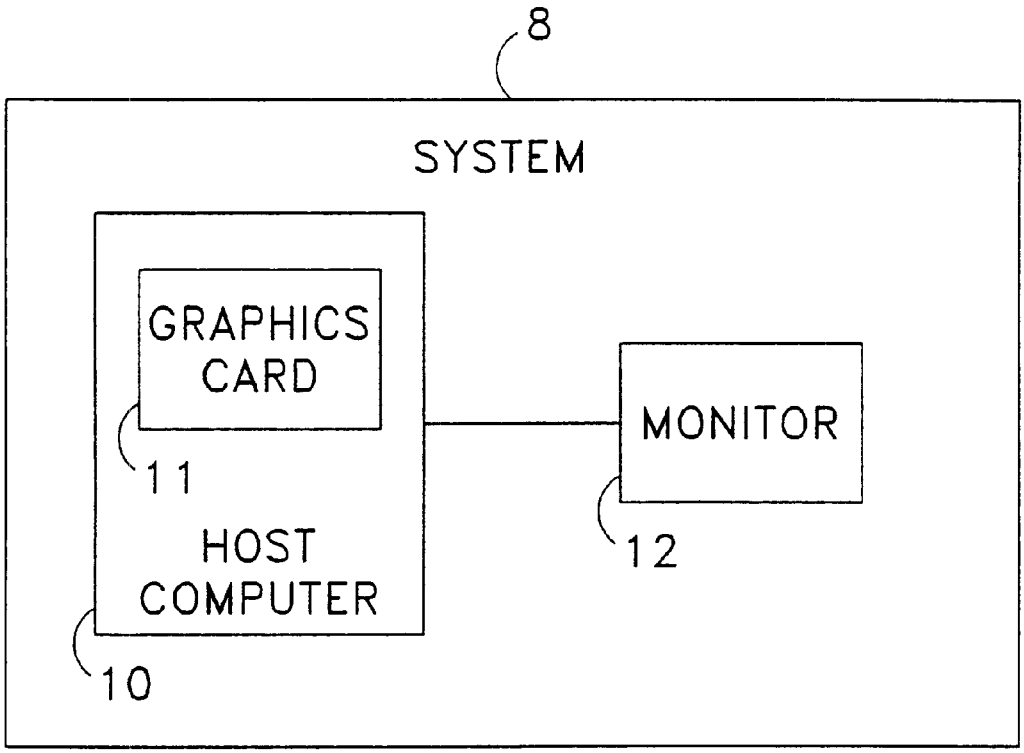
FIG. 1 is a simplified schematic diagram of a system including a host computer and monitor.

Turning now to the drawings, FIG. 1 shows a simplified schematic diagram of a system 8 including a host computer 10 and a video monitor 12. The host computer 10 includes a graphics or video card 11 for communicating video information (e.g. pixel information) from the host computer 10 to the monitor 12. The monitor 12 is preferably a high frequency monitor. Host systems other than the host computer system 10 may alternatively drive the monitor 12.

Figure 2:
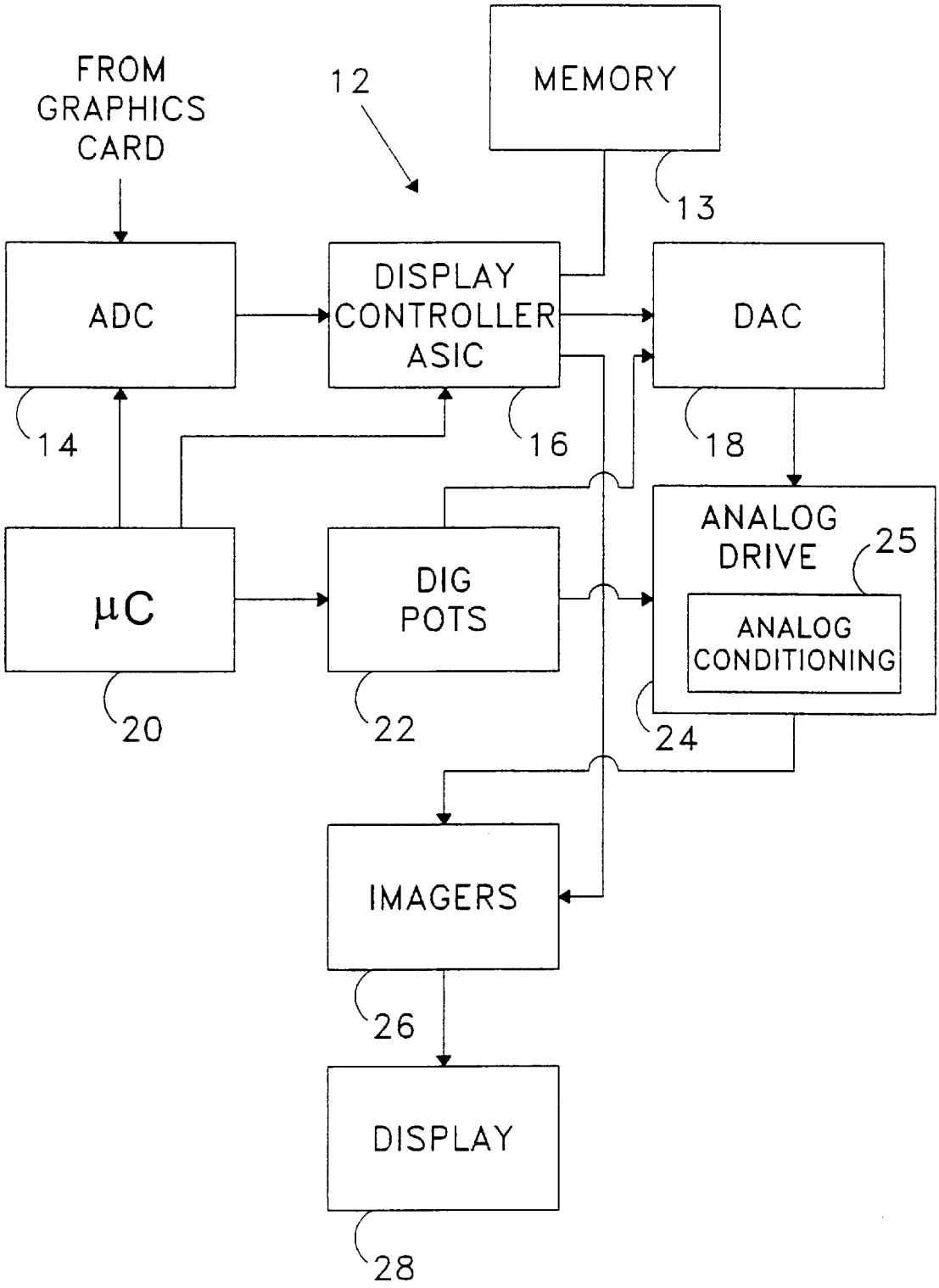
FIG. 2 is a schematic diagram of an exemplary video architecture of the monitor of FIG. 1 incorporating analog conditioning circuitry in accordance with the present invention.

Referring to FIG. 2, a schematic diagram of an exemplary video architecture of the monitor 12 is shown. A video signal from the graphics card 11 of the host computer 10 is provided to an analog-to-digital converter (ADC) 14 which digitizes the video signal. In the disclosed embodiment, the analog-to-digital converter 14 is at least a 8-bit analog-to-digital converter providing three analog input channels. An example of a suitable analog-to-digital converter 14 is the "Paradise Bridge 120" available from Paradise Electronics.

Figure 3:
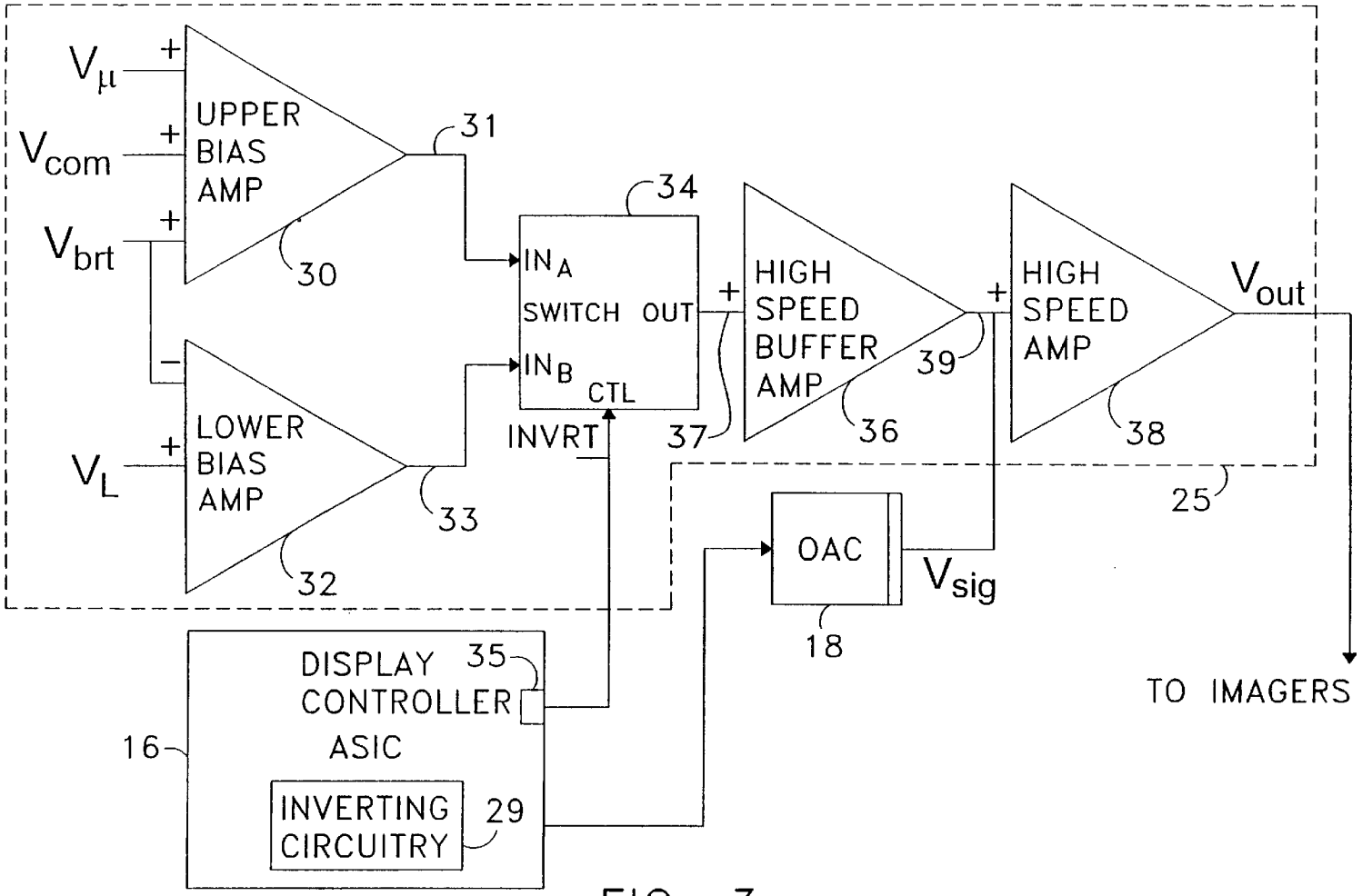
FIG. 3 is a circuit schematic diagram of the analog conditioning circuitry of FIG. 2 in accordance with the present invention.

A display controller ASIC 16 (FIGS. 2 and 3) receives the digitized video signal from the ADC 14. The display controller ASIC 16 is configured for processing (e.g., scaling or buffering) the digital video signal. In the disclosed embodiment, the display controller ASIC 16 includes an imager interface, a microcontroller interface, two memory controllers, and general purpose ports. The processed video signal is provided from the display controller ASIC 16 to a digital-to-analog converter (DAC) 18 (FIGS. 2 and 3). The DAC 18 converts the digital video signal to an analog video signal. In the disclosed embodiment, the DAC 18 is a 8-bit to 10-bit current output digital-to-analog converter. The DAC 18 is preferably capable of mapping at least 256 input levels. An example of a suitable DAC is the HI3050 available from Harris Semiconductor.

The ADC 14 is coupled to a microcontroller ($\mu$C) 20. The microcontroller 20 configures the ADC 14 for video data digital conversion. The microcontroller 20 is also responsible for configuring the display controller ASIC 16. An example of a suitable microcontroller 20 is the 80C930HF microcontroller available from Intel Corporation. The ASIC 16 places digital data in a memory 13 and later retrieves data from the memory 13 to be provided to the DAC 18.

The video architecture of the monitor 12 further includes a plurality of digital potentiometers (DIG POTs) 22. The microcontroller 20 programs the DIG POTs 22 through a control signal. Each digital potentiometer 22 is basically a digitally controlled variable resistor. A resistance value of a digital potentiometer 22 is a function of a position of a wiper with respect to two endpoints. In the disclosed embodiment, each digital potentiometer 22 provides at least 256 positions (or contact points). An example of a suitable digital potentiometer chip is the AD8403 available from Analog Devices, Inc. A digital signal reflecting the resistance value of the digital potentiometer 22 is provided to the DAC 18. In accordance with the present invention, the analog drive circuitry 24 includes analog conditioning circuitry 25. The analog conditioning circuitry 25 basically takes the output of the DAC 18 and places it in a condition which imagers 26 described below need to see. The analog conditioning circuitry 25 is described in detail below.

The DAC 18 provides an analog signal to analog drive circuitry 24. The DIG POTs 22 drive the bias voltage signals described below for the analog drive circuitry 24. The analog drive circuitry 24 provides a plurality of analog drive signals to one or more imagers 26. The imagers 26 receive clocking and configuration signals from the display controller ASIC 16. The imagers 26 are preferably refreshed at a scanning frequency of greater than 60 hertz. In the disclosed embodiment each imager 26 may be a silicon-based light valve which requires DC balancing. An imager 26 essentially converts light intensity modulation information contained in an analog drive signal to light energy emitted to a display 28. The display 28 may take the form of a variety of display types. In the disclosed embodiment, the display 28 is a liquid crystal display (LCD).

Referring to FIG. 3, an exemplary circuit schematic diagram of analog conditioning circuitry 25 is shown. The analog conditioning circuitry 25 includes an upper bias operational amplifier 30, a lower bias operational amplifier 32, a switch 34, a high speed buffer operational amplifier 36, and a high speed summing operational amplifier 38. While the high speed buffer operational amplifier 36 is preferably provided, the amplifier 36 is not a necessary component of the analog conditioning circuitry 25.

In the disclosed analog conditioning circuit configuration, the upper bias operational amplifier 30 receives an upper bias DC voltage signal $V_u$, a reference DC voltage signal $V_{com}$, and a brightness voltage signal $V_{brt}$. The reference DC voltage signal $V_{com}$ corresponds to the DC signal level of the display 28. The reference DC voltage signal $V_{com}$ may be supplied or set by an adjustable voltage regulator. An example of a suitable voltage regulator is the LM317 available from National Semiconductor Corporation. In the disclosed embodiment, for the particular type of imager utilized, the reference DC voltage signal $V_{com}$ is typically six volts. Each of the received voltages is summed by the operational amplifier 30. The brightness voltage signal $V_{brt}$ is also provided to an inverting input terminal of the operational amplifier 32. A lower bias DC voltage signal $V_L$ is provided to the non-inverting input terminal of the operational amplifier 32. Examples of a suitable operational amplifier for the amplifiers 30 and 32 is the LM324 available from numerous companies providing analog components.

The switch 34 provides two input terminals ($IN_A$ and $IN_B$), an output terminal (OUT), and a control terminal (CTL). Every other frame, the switch 34 selects either an upper DC offset voltage signal 31 generated by the operational amplifier 30 or a lower DC offset voltage signal 3 generated by the operational amplifier 32. Both the lower DC offset voltage signal and the upper DC offset voltage signal are low speed precision DC voltage signals. The upper DC offset voltage signal 31 corresponds to a voltage level in an upper operating range, and the lower DC offset voltage signal 33 corresponds to a voltage level in a lower operating range.

The switch 34 also receives an inversion signal INVRT_ at its control terminal (CTL) from an inversion bit 35 of the display controller ASIC 16. In the disclosed embodiment, the inversion signal INVRT_ is an imager interface signal having an active low output. For a positive leg when the inversion signal INVRT_ is deasserted, digital data is inverted. For a "negative" leg when the inversion signal INVRT_ is asserted, digital data is non-inverted. The display ASIC 16 includes inverting circuitry for inverting data every other frame. Certain components of the display controller ASIC 16 have been omitted for clarity. While digital data inversion and non-inversion are disclosed from a frame-by-frame perspective, it should be understood that digital data inversion and non-inversion in accordance with the present invention may be utilized at any rate suitable for the particular imager.

The DC offset voltage signal 37 selected by the switch 34 is provided to the high speed buffer operational amplifier 36. The operational amplifier 36 serves to buffer the DC offset voltage signal 37. An example of a suitable high speed amplifier for buffering is the AD8054 available from Analog Devices, Inc. The buffer amplifier 36 serves to isolate and buffer low speed signals from high speed signals.

The DC offset voltage signal 39 provided by the operational amplifier 36 and a high speed analog voltage signal $V_{sig}$ provided by the DAC 18 are summed by the high speed operational amplifier 38. The summing amplifier 38 sees a low impedance from the buffer amplifier 36. Every other frame, the DAC 18 receives inverted digital data from the ASIC 16. The operational amplifier 38 provides an output voltage signal $V_{out}$ with an upper operating range between zero and a predetermined relative positive voltage level and a lower operating range between zero and a predetermined relative negative voltage level (i.e., a voltage level which is negative relative to the reference DC voltage signal $V_{com}$). It should be understood that the upper operating range and the lower operating range are positive voltage levels. The output voltage signal $V_{out}$ on average provides a zero DC voltage level change. That is, the output voltage signal $V_{out}$ is a DC-balanced signal. When the upper DC offset voltage signal 31 is selected, the output voltage signal $V_{out}$ may be represented by the following equation:

$$V_{out}=A(V_u+V_{bri}+V_{com})+(V_{sig})B.$$

The A constant represents the gain of the low speed path defined by the amplifier 30, the switch 34. and the amplifier 31. The B constant represents the gain of the high speed path defined by the DAC 18. When the lower DC offset voltage signal 33 is selected, the output voltage signal $V_{out}$ may be represented by the following equation:

$$V_{out}=C(V_L-V_{bri})+(\overline{V}_{sig})B.$$

Here, the C constant represents the gain of the low speed path defined by the amplifier 32, the switch 34, and the amplifier 36. The B constant represents the gain of the high speed path defined above. The equation includes a bar over the high speed analog voltage signal $V_{sig}$ to indicate the video signal is generated from digitally inverted data. $V_{sig}$ in the first equation above is the high speed analog signal generated from digitally non-inverted data. The output voltage signal $V_{out}$ is symmetrical about the reference DC voltage signal $V_{com}$.

Thus, on an input side of the high speed operational amplifier 38, a low speed load in the form of the DC offset voltage signal 39 and a high speed load in the form of the high speed analog voltage signal $V_{sig}$ are combined. The operational amplifier 38 thereby sums a precision low speed DC voltage signal 39 with a high speed analog voltage signal $V_{sig}$. The precision low speed DC offset voltage signal 39 is essentially used to position the high speed analog voltage signal $V_{sig}$. By separating the high speed load and signal path from the low speed load and signal path prior to the operational amplifier 38, both precision DC voltage signals and high speed analog voltage signals are supported. Although the analog conditioning circuitry 25 provides precision low speed voltage signals, it should be understood that ultra precision operational amplifiers are not necessary to accomplish generation of such signals.

While conventional analog drive circuitry has included a distinct positive gain path and a distinct negative gain path, the disclosed analog conditioning circuitry 25 provides a single gain path for providing both positive and negative offsets relative to the reference DC voltage signal $V_{com}$. In this way, the positive gain and negative gain may more easily be matched. The single gain path switches between providing positive gain and negative gain without the need to match any components and parameters of separate gain paths. Another advantage of a single gain path is presenting a single gain to the high speed signal path.

The disclosed analog conditioning circuitry 25 also provides low speed signal paths decoupled from the high speed signal path. In this way, precision adjustments may be made in the low speed paths away from the high speed path.

It should be apparent to one skilled in the art that the disclosed analog conditioning circuitry 25 may be supplemented by a variety of other circuitry. For example, circuitry may be added to provide attenuation stages following the operational amplifier 38 so as to maintain signal integrity. Circuitry may also be added for maintaining a steady DC signal during transient switching by the disclosed circuitry. Even further, low pass filters or other suitable filters may be provided to aid in balancing feedback.

Figure 4:
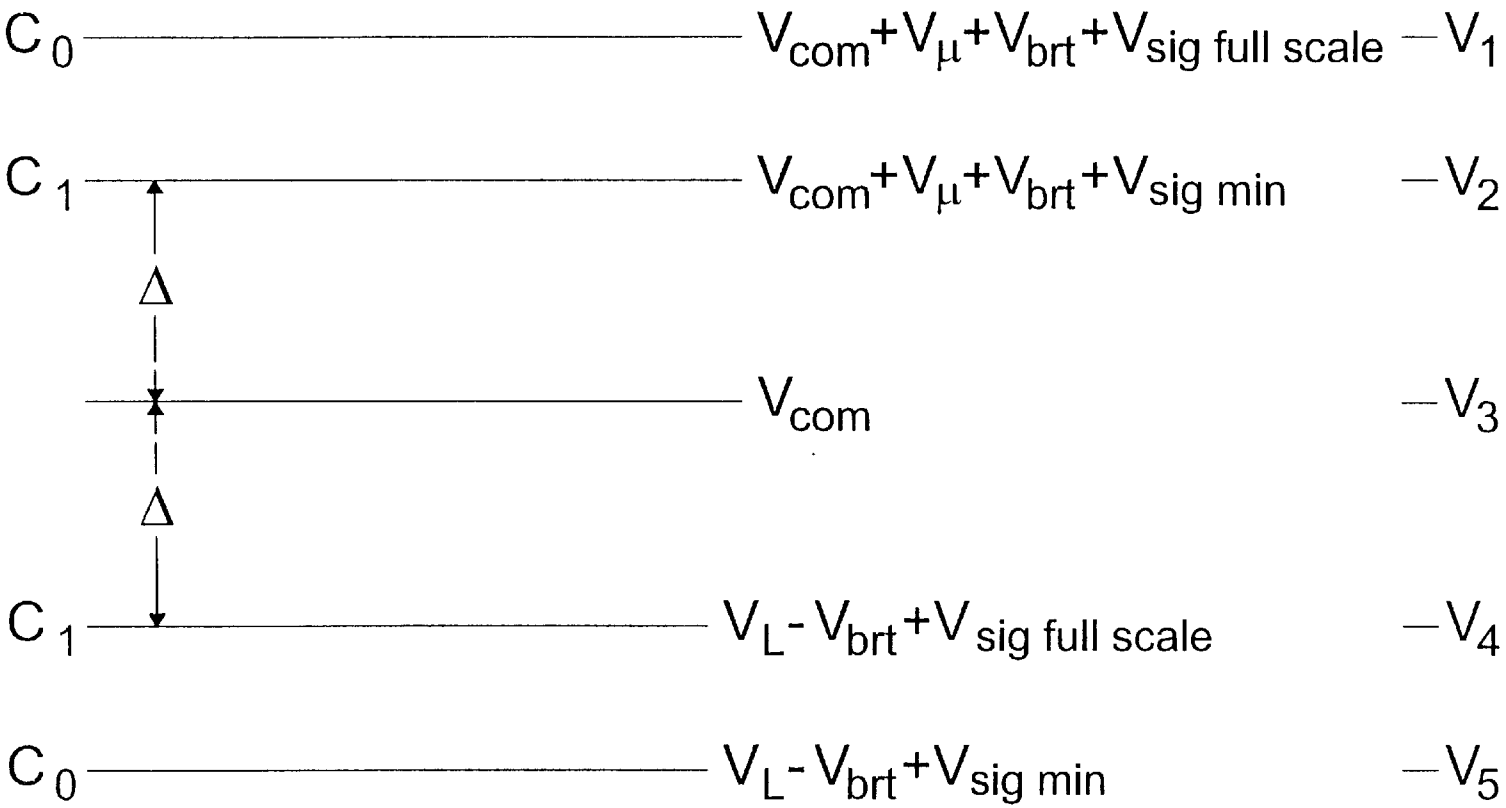
FIG. 4 is a signal diagram of exemplary output voltage levels for the analog conditioning circuitry of FIG. 3 in accordance with the present invention.

Referring to FIG. 4, a signal diagram of exemplary output voltage levels for the output voltage signal $V_{out}$ is shown. The signal diagram illustrates an upper operating signal range and a lower operating signal range. With respect to video information, the voltage level furthest from the reference DC voltage signal $V_{com}$ of each operating range represents a color $C_0$, and the voltage level corresponding to a DC offset voltage signal in each operating range represents a color $C_1$. Exemplary voltage values are provided beside each illustrated voltage signal level. In particular, the highest voltage level ($V_{com}+V_{max}$) of the upper operating range corresponds to $V_1$, the voltage level in the upper operating range associated with a DC offset voltage signal corresponds to $V_2$ volts; the reference voltage signal $V_{com}$ corresponds to $V_3$ volts; the voltage level in the lower operating range associated with a DC offset voltage signal corresponds to $V_4$ volts; and the lowest voltage level ($V_{com}-V_{max}$) of the lower operating range corresponds to $v_5$ volts. For both operating ranges, the symbol Δ represents the voltage difference between color $C_1$ and the reference DC voltage signal $V_{com}$.

The high speed analog signal $V_{sig}$ derived from non-inverted digital data is positioned within the upper operating range by the upper DC offset voltage signal 31. The high speed analog signal $V_{sig}$ derived from inverted digital data is positioned within the lower operating range by the lower DC offset voltage signal 33. In both operating ranges, the high speed analog signal $V_{sig}$ ranges between $C_0$ and $C_1$. In the upper operating range, if a minimum value (i.e., 0) is input into the DAC18, then the high speed analog signal $V_{sig}$ is a minimum value (i.e., 0). In such a case, the output voltage signal $V_{out}$ corresponds to $C_1$ and $V_2$. If a full scale or maximum value is input into the DAC18, then the high speed analog signal $V_{sig}$ is a full scale value. In such a case, the output voltage signal $V_{out}$ corresponds to $C_0$ and $V_1$. In the lower operating range, if a minimum value is input into the DAC18, then the high speed analog voltage signal $V_{sig}$ is a full scale value. In such a case the output voltage signal $V_{out}$ corresponds to $C_0$ and $V_5$. If a maximum value is input into the DAC18, then the high speed analog voltage signal $V_{sig}$ is a minimum value. In such a case, the output voltage signal $V_{out}$ corresponds to $C_1$ and $V_4$.

It will be appreciated by those skilled in the art that the voltage levels associated with the analog conditioning circuitry 25, when the digital data should be inverted, and when the digital data should be non-inverted are dependent upon the type of imager being driven and the particular voltage level of that imager.

The foregoing disclosure and description of the preferred embodiment are illustrative and explanatory thereof, and various changes in the components, circuit elements, signals, display techniques, and monitor environments, as well as in the details of the illustrated circuitry and construction and method of operation may be made without departing from the spirit of the invention.

What is claimed is:

1. An analog conditioning circuit for driving a plurality of imagers for a display, comprising:

a single DC signal path for generating selectable positive and negative DC offset voltages with respect to a reference voltage;

an analog video signal path, separate from the single DC signal path, for supplying an analog video signal; and a combiner for combining the selectable positive and negative DC offset voltages with the analog video signal to produce an analog signal selectively offset positively or negatively with respect to the reference voltage.

2. The conditioning circuit of claim 1, wherein the single DC signal path comprises:

an upper bias amplifier block, coupled to receive a first input signal and generate an upper DC offset voltage;

a lower bias amplifier block coupled to receive a second input signal and generate a lower DC offset voltage;

a switching block, coupled to receive the upper and lower DC offset voltages and to alternate a selection of the upper and lower DC offset voltages; and a select signal generator coupled to generate a select signal and provide the select signal to the switching block.

3. The conditioning circuit of claim 1, wherein the analog video signal path comprises:

a digital-to-analog converter coupled to receive inverted and non-inverted digital video signals and output the analog video signal to the combiner.

4. A method of generating a high speed symmetrical analog voltage signal for driving an imager, comprising:

providing a single low speed DC signal path, wherein the single low speed DC signal path comprises selectable positive and negative DC offset voltages with respect to a reference voltage;

providing a high speed analog video signal path, separate from the single low speed DC signal path, for supplying a high speed analog video signal; and combining the selectable positive and negative DC offset voltages with the high speed analog video signal to produce an analog signal selectively offset positively or negatively with respect to the reference voltage.

5. The method of claim 4, further comprising periodically inverting the high speed analog video signal with respect to a source.

6. The method of claim 5, wherein the inverting is performed on every other frame of the high speed analog video signal.

7. The method of claim 4, wherein the high speed analog video signal is derived from periodically inverted digital data.

8. The method of claim 4, further comprising periodically inverting the selectable positive and negative DC offset voltages.

9. A method of generating a symmetrical analog voltage signal for driving an imager, comprising:

providing a single DC signal path, wherein the single DC signal path comprises selectable positive and negative DC offset voltages with respect to a reference voltage;

providing a analog video signal path, separate from the single DC signal path, for supplying an analog video signal; and combining the selectable positive and negative DC offset voltages with the analog video signal to produce an analog signal selectively offset positively or negatively with respect to the reference voltage.

10. The method of claim 9, further comprising periodically inverting the analog video signal with respect to a source.

11. The method of claim 10, wherein the inverting is performed on every other frame of the analog video signal.

12. The method of claim 9, wherein the analog video signal is derived from periodically inverted digital data.

13. The method of claim 9, further comprising periodically inverting the selectable positive and negative DC offset voltages.

14. A monitor, comprising:

a display;

at least one imager, coupled to provide light energy to the display;

an analog conditioning circuit, coupled to supply a high speed symmetrical analog output voltage signal to the at least one imager, wherein the analog conditioning circuit comprises, an upper bias amplifier block, coupled to receive a first input signal and generate an upper DC offset voltage signal;

a lower bias amplifier block, coupled to receive a second input signal and generate a lower DC offset voltage signal;

a switching block, coupled to receive the upper and lower DC offset voltage signals and to alternate a selection of the upper and lower DC offset voltage signals;

a select signal generator, coupled to generate a select signal and provide the select signal to the switching block;

a high speed analog output block, coupled to the select signal generator for generating a high speed analog voltage signal from inverted and non-inverted digital data; and a merge block, coupled to receive and combine a selected DC offset voltage signal and the high speed analog voltage signal to generate a high speed symmetrical analog output voltage signal;

a digital-to-analog converter, coupled to supply an analog video signal to the analog conditioning circuit;

a display controller, coupled to supply a processed digital video signal to the digital-to-analog converter; and an analog-to-digital converter, coupled to receive an analog signal from a graphics card and supply a digital video signal to the display controller.

15. The monitor of claim 14, further comprising a memory, coupled to the display controller, and configured to store digital video data.

16. The monitor of claim 14, further comprising a micro controller, coupled to configure the analog-to-digital converter and the display controller.

17. The monitor of claim 16, further comprising a plurality of digital potentiometers, coupled to the micro controller to receive a control signal, and configured to provide digital signals to the digital-to-analog converter and the analog conditioning circuit.

18. A monitor, comprising:

a display;

at least one imager, coupled to provide light energy to the display;

an analog conditioning circuit, coupled to supply a high speed symmetrical analog output voltage signal to the at least one imager, wherein the analog conditioning circuit comprises, a single DC signal path for generating selectable positive and negative DC offset voltages with respect to a reference voltage;

an analog video signal path, separate from the single DC signal path, for supplying an analog video signal; and a combiner for combining the selectable positive and negative DC offset voltages with the analog video signal to produce an analog signal selectively offset positively or negatively with respect to the reference voltage.

19. The monitor of claim 18, wherein the single DC signal path comprises:

an upper bias amplifier block, coupled to receive a first input signal and generate an upper DC offset voltage;

a lower bias amplifier block coupled to receive a second input signal and generate a lower DC offset voltage;

a switching block, coupled to receive the upper and lower DC offset voltages and to alternate a selection of the upper and lower DC offset voltages; and a select signal generator coupled to generate a select signal and provide the select signal to the switching block.

20. The monitor of claim 18, wherein the analog video signal path comprises:

a digital-to-analog converter coupled to receive inverted and non-inverted digital video signals and output the analog video signal to the combiner.

* * * * *